US010018149B2

(12) United States Patent
Iockheck

(10) Patent No.: US 10,018,149 B2
(45) Date of Patent: Jul. 10, 2018

(54) DIFFERENTIAL THERMODYNAMIC MACHINE WITH A CYCLE OF EIGHT THERMODYNAMIC TRANSFORMATIONS, AND CONTROL METHOD

(71) Applicant: ABX ENERGIE LTDA, Curitiba, Parana (BR)

(72) Inventor: Marno Iockheck, Curitiba (BR)

(73) Assignee: ABX ENERGIA LTDA, Curitiba (PA)

( * ) Notice: Subject to any disclaimer, the term of this patent is extended or adjusted under 35 U.S.C. 154(b) by 141 days.

(21) Appl. No.: 15/030,080

(22) PCT Filed: Oct. 16, 2014

(86) PCT No.: PCT/BR2014/000381
§ 371 (c)(1),
(2) Date: Apr. 18, 2016

(87) PCT Pub. No.: WO2015/054767
PCT Pub. Date: Apr. 23, 2015

(65) Prior Publication Data

US 2016/0252047 A1 Sep. 1, 2016

(30) Foreign Application Priority Data

Oct. 16, 2013 (BR) ..... 1020130266345

(51) Int. Cl.

| | |
|---|---|
| ***F02G 1/043*** | (2006.01) |
| ***F02G 1/044*** | (2006.01) |
| ***F02G 1/05*** | (2006.01) |
| ***F02G 1/055*** | (2006.01) |

(52) U.S. Cl.
CPC ..... *F02G 1/05* (2013.01); *F02G 1/043* (2013.01); *F02G 1/044* (2013.01); *F02G 1/055* (2013.01); *F02G 2244/10* (2013.01); *F02G 2250/00* (2013.01); *F02G 2250/09* (2013.01); *F02G 2270/00* (2013.01); *F02G 2270/90* (2013.01)

(58) Field of Classification Search
CPC . F02G 1/043; F02G 1/044; F02G 1/05; F02G 1/055; F02G 2244/10; F02G 2250/00; F02G 2250/09; F02G 2270/00; F02G 2270/90
See application file for complete search history.

(56) References Cited

U.S. PATENT DOCUMENTS

2007/0193266 A1* 8/2007 McConaghy ..... F02G 1/0435 60/520
2010/0287936 A1 11/2010 Klutchenko

FOREIGN PATENT DOCUMENTS

BR PI1000624 10/2011
BR 102012015554 12/2014

* cited by examiner

*Primary Examiner* — Audrey K Bradley
(74) *Attorney, Agent, or Firm* — Bay State IP, LLC

(57) ABSTRACT

The present invention refers to the technical field of thermodynamic engines, and more specifically to a heat engine that operates with gas in closed loop in differential configuration which is characterized by performing a thermodynamic cycle eight transformations or otherwise explain, it performs two thermodynamic cycles simultaneously, each with four interdependent, additional transformations, two of these transformations "isothermal" and two "adiabatic" in mass transfer in phases of adiabatic processing to provide a new performance curve no longer dependent solely on temperature but the mass transfer rate which allows the construction of machines with high yields and low thermal differentials.

6 Claims, 8 Drawing Sheets

PRIOR ART Fig. 01

DIFFERENTIAL THERMODYNAMIC MACHINE WITH A CYCLE OF EIGHT THERMODYNAMIC TRANSFORMATIONS, AND CONTROL METHOD

CROSS REFERENCE TO RELATED APPLICATION

This application is for entry into the U.S. National Phase under § 371 for International Application No. PCT/BR2014/000381 having an international filing date of Oct. 16, 2014, and from which priority is claimed under all applicable sections of Title 35 of the United States Code including, but not limited to, Sections 120, 363, and 365(c), and which in turn claims priority under 35 USC 119 to Brazilian Patent Application No. BR1020130266345 filed on Oct. 16, 2013.

TECHNICAL FIELD OF THE INVENTION

The present invention refers to the technical field of thermodynamic engines, and more specifically to a heat engine characterized by two thermodynamic subsystems that operates with gas in a closed loop and in a differential configuration which is characterized by performing a thermodynamic cycle, wherein the thermodynamic cycle comprises eight processes or otherwise explain, it performs two interdependent thermodynamic cycles simultaneously, each with four processes, two of these processes are "isothermal" and two are "adiabatic", with mass transfer of gas.

This engine operates in accordance with the principles of thermodynamics, specifically according to the fundamentals of Nicolas Leonard Sadi Carnot, or commonly "Carnot" whose stated secular and accepted in the scientific community does not change, "To be continued conversion of heat work, a system must perform cycles between hot and cold sources, continuously. In each cycle, is withdrawn a certain amount of heat from the hot source (useful energy) which is partially converted into work, the remainder being rejected to the cold source (energy dissipated)".

BACKGROUND OF THE INVENTION

At present, the world's needs for energy and mechanical tensile strength became challenges whose solutions has brought devastating climate implications. The studies by international organizations such as the UN reveal impacts of extreme gravity to the planet. The use of fossil fuels, oil, gas, coal, of which depend on the world economy, is causing global warming, reduction of polar ice sheets, climate change, high concentrations of gases that produce the greenhouse effect, among other problems. Other energy sources, such as nuclear, used by most developed nations in turn are subject to lead to serious accidents by failures of various orders, among these are the very climate changes that enhance events such as storms, hurricanes, among others.

In the last two hundred years, it has been invented various heat engines for use in industry and to generate power for the population, the most known technologies and economically viable to date are.

Engine Rankine cycle, mathematically demonstrated in 1859 by William John Macquorn Rankine, engine used in jets and in generating energy operate the Brayton cycle, created in 1872 by George Brayton, proposed earlier in 1791 by John Barber, used as energy source also materials derived from fossil fuels, kerosene, gas. Internal combustion engines used in automobiles operate at Otto cycle developed by Nikolaus Otto 1876 also uses fossil fuels, gasoline, nowadays also vegetable origin alcohol. Internal combustion engines used in heavy vehicles, trucks, trains, ships and industrial applications, operating by the Diesel cycle, developed by Rudolf Diesel in 1893, also uses fossil fuels, diesel oil, now also of plant origin, biodiesel. External combustion engines, currently used in projects of alternative energy, operate the Stirling cycle developed by Robert Stirling in 1816, uses various energy sources, currently focused on cleaner sources and less environmental impact, such as biomass, hot springs, thermosolar.

All the technologies presented above are heat engines with thermodynamic cycles of four processes and all of them are references, i.e. its thermodynamic cycle are referenced to the neighborhood and this is the environment, which can be the atmosphere, the space in which they are, for example: the internal combustion engines, after the completion of work on a mechanical force element, piston, turbine, gases are released to the environment, so the forces of the gases push the driving force elements going towards their respective neighborhoods, i.e. the environment. In the case of Stirling engines, its thermodynamic cycle of four processes, two isotherms and two isochoric occurs with gas always confined in the same environment and the driving force occurs through the displacement of an element, e.g., a piston against its neighborhood, the external environment or other pressurized or vacuum chamber.

All engines known to date are based on the Carnot concept, the Carnot cycle, and thus the foregoing state of the art, shown in FIG. 01, is defined.

THE CURRENT STATE OF THE TECHNIQUE

Among the heat engines of closed loop, those similar to the present technology for this reason, i.e. only be closed loop are the Stirling engine, there is Alfa type engines such as those published in U.S. Pat. No. 7,827,789 and US20080282693 patent type beta as the patent US20100095668, Gamma as the patent US20110005220, Stirling Rotating engines such as U.S. Pat. No. 6,195,992 and U.S. Pat. No. 6,996,983 patent, hybrid Wankel-type Stirling as U.S. Pat. No. 7,549,289 and other references as: The PI0515980-6 which is a method with Stirling principle, the PI0515988-1, as is a method with Stirling principle, WO03018996 A1, which is a rotating Stirling cycle engine, WO2005042958 A1, an engine Stirling type Beta cycle, WO2006067429A1 a Stirling cycle engine free piston, the WO2009097698A1, is a method to heat engine modified Carnot cycle, WO2009103871A2, which is a Stirling cycle engine or Carnot, the WO2010048113A1 a balanced Stirling cycle engine, WO201006213A2, defined as a Stirling cycle heat engine, the WO2011005673A1, which is a Stirling cycle engine of Gamma type. All references define models, methods and innovations in thermal engines of closed loop of Stirling cycle, which is two isotherms and two isochoric processes occurring one after the other sequentially.

OBJECTS OF THE INVENTION

On the other hand, the technology described in the present description presents a closed circuit engine, but it is not comprised of a cycle of four processes, but by a new concept in one configuration the differential so that it performs an eight processing cycle, where in pairs, two by two, with mass transfer, maintaining and following the concepts of thermodynamics, Carnot, but it obliges to consider the weight variation in the equations, providing a possibility not considered in the current thermal engine, i.e. concept of this technology offers a new condition that influences the efficiency, allowing the most efficient engine design where the income limit no longer requires the sole and exclusive dependence on temperature, but considers the mass transfer rate between the chambers conversion so that the income equation is replaced by a new factor.

The innovations presented in this patent text are evolutions of previous patents, PI000624-9 called "Thermomechanical Energy Converter" and BR1020120155540 called "Thermal engine that operates in compliance with the Thermodynamic Cycle of Carnot" written by the same author of this patent.

The technology developed, subject of this patent text, does not address an ideal engine without loss, however it is an engine capable of performing high-precision differential mode the eight processes of thermodynamic cycle from a heat source of any kind, accordingly, it has key features currently desired for designs of engines for driving force or power generation plants. The same brings benefits of practical application and economic and as each design, power ranges and characteristics of heat sources, could perform very high yields, surpassing the efficiency of most other engines considered high efficiency, for not having their income dependent only on temperature.

Another objective of particular importance is the use of this technology in flexible power generation plants as the thermal sources economically viable income in relation generated power versus heat source and with minimal environmental impact, such as the use of clean heat sources such as solar, thermo, low environmental impact such as biofuels and economic as the use of waste and pre-existing plants where it operates by heat loss, making cogeneration systems, or added to other technologies forming more complex processes called combined cycle for example forming Brayton-Differential Combined cycle systems, using as a heat source gases at high temperatures released by the Brayton cycle turbines, Rankine-differential whose heat source is steam outputs of the last stages of steam turbines and gas chimneys, diesel-differential whose heat source is the cooling fluid the diesel engine, Otto-differential whose heat source is the cooling fluid the Otto cycle engine, among others, significantly broadening the efficiency as that the processes of thermal engines Brayton cycle, Rankine, Diesel, Otto, have many thermal losses impossible to be taken advantage of by their own dependent thermodynamic cycles of high temperatures, requiring alternative more efficient systems for this use.

DESCRIPTION OF THE INVENTION

The engines of differential cycles are engines characterized by two thermodynamic subsystems where they run two interdependent thermodynamic cycles with exchange of mass and energy with each other, constituting a more complex binary cycle, and these engines are based on the hybrid thermodynamic system, and the hybrid thermodynamic system is a system characterized by the junction of the closed thermodynamic system with the open thermodynamic system.

DESCRIPTION OF THE DRAWINGS

The accompanying figures demonstrate the main characteristics and properties of the new hybrid thermodynamic concept and the differential engine with eight changes of thermodynamic cycle, otherwise, an engine with a cycle formed by eight thermodynamic processes.

DETAILED DESCRIPTION OF THE INVENTION

This invention presents a new concept of a thermal engine, or heat engine, based on a new concept of thermodynamic system, which we are calling a hybrid thermodynamic system because it is composed of the junction of the open thermodynamic system with the closed thermodynamic system, both developed in the nineteenth century.

Figure 1:
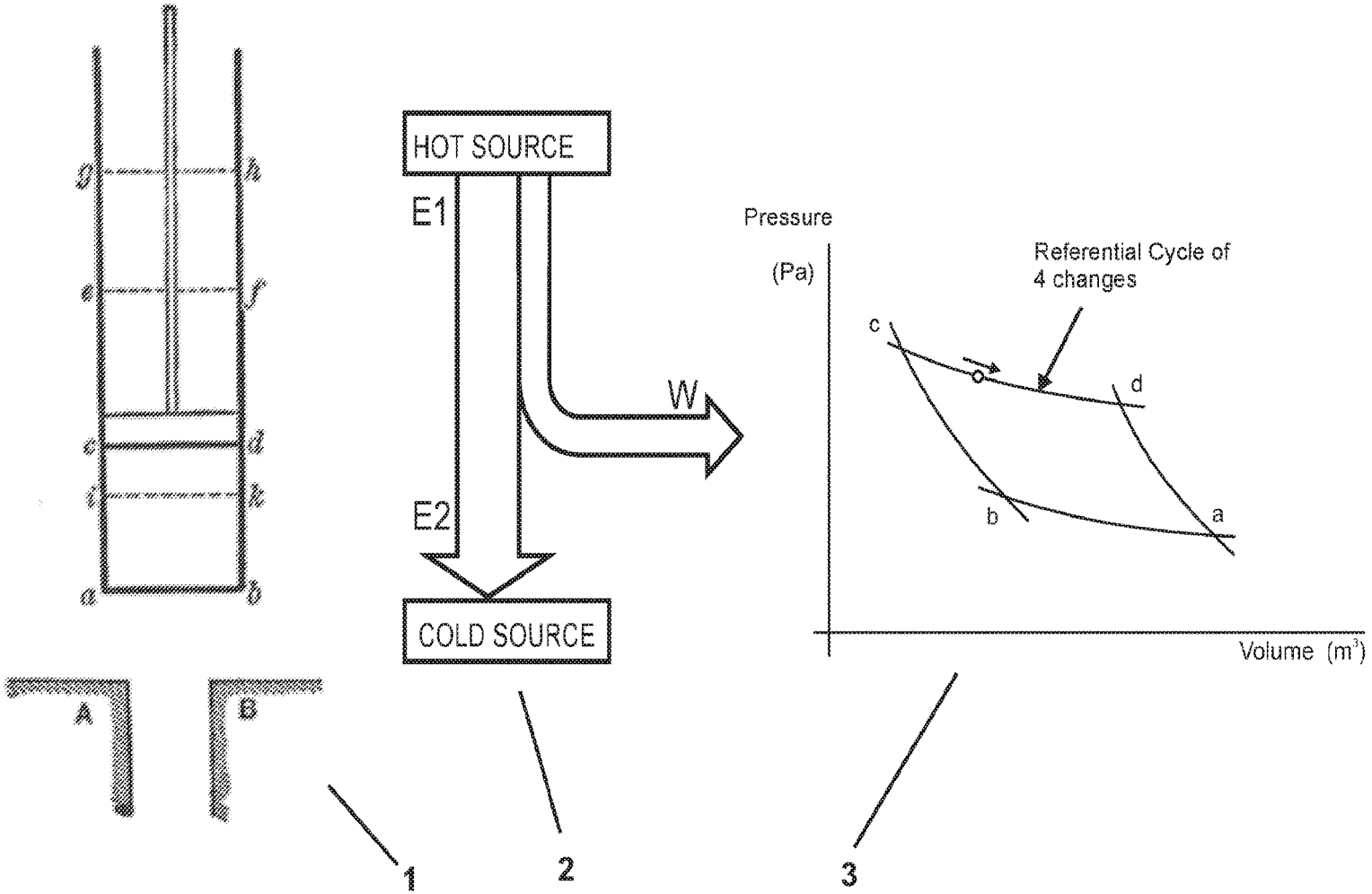
FIG. 01 represents a prior art of the heat engine, based on Carnot cycle.

In FIG. 01 is shown the original engine of Carnot 1, the flow diagram of Carnot engine and other heat engines operating on the four thermodynamic processes, or transformations ring 2, the cycle graph of Carnot engine with its four processes 3.

Figure 2:
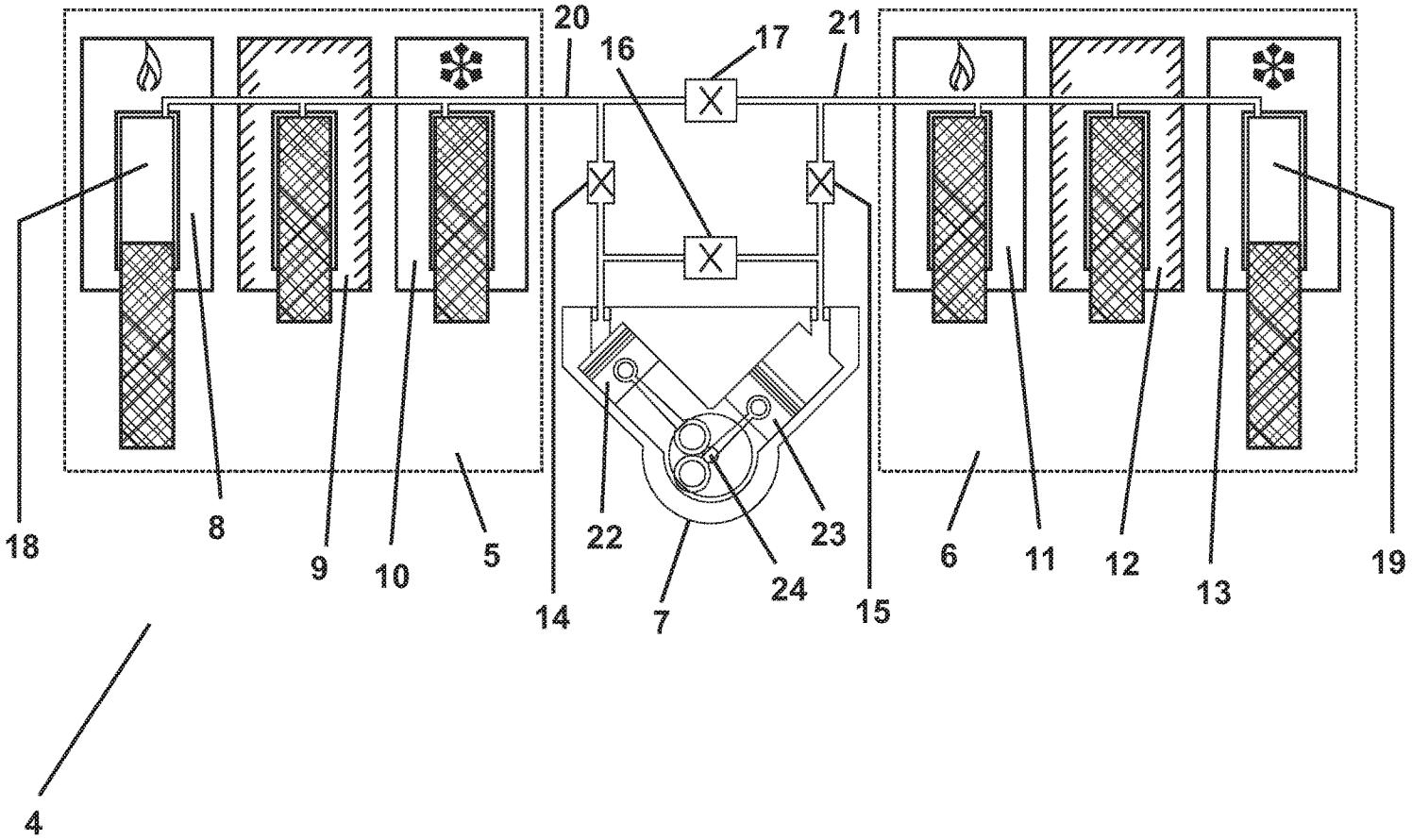
FIG. 02 represents the simplified mechanical model of a differential cycle engine based on a hybrid thermodynamic system.

In FIG. 02 is shown Differential engine 4 comprised by two chambers of thermodynamic processes 5 and 6, each chamber with three sections, respectively 8, 9, 10 and 11, 12, 13, each section has its movable piston, controllable, each chamber with a gas volume 18 and 19, channels for the working gas flow 20 and 21, bypass valve 17, control valve assembly 14 and 15 and one valve 16 to release the inertial operation of the driving force element, one driving force element or impellent 7, pistons 22 and 23 of driving force element, crankshaft type 24 of driving force element.

Chambers with three sections can be constituted in various ways, are already in the art, can be by pistons, as exemplified, we used this model to facilitate the understanding of the technology described herein can be in the form of disks contained in a housing ring which back advantages for pressure equalization, item contained in the prior art, as well as actuators to move the pistons or chambers of three sections, which may be using electrical motors, servomotors, pneumatic or even by direct mechanical means.

The working gas never changes the physical state in any of the eight processes of the cycle, always in gaseous state and can be chosen according to the project due to its properties, the main ones are the Helio gas, hydrogen, neon, nitrogen and dry air of the atmosphere.

In FIG. 03 is shown again differential engine 4, the heat flow diagram of the differential engine 25 and the comparative graph of the thermodynamic cycle of the differential engine and the Carnot engine 26.

Figure 4:
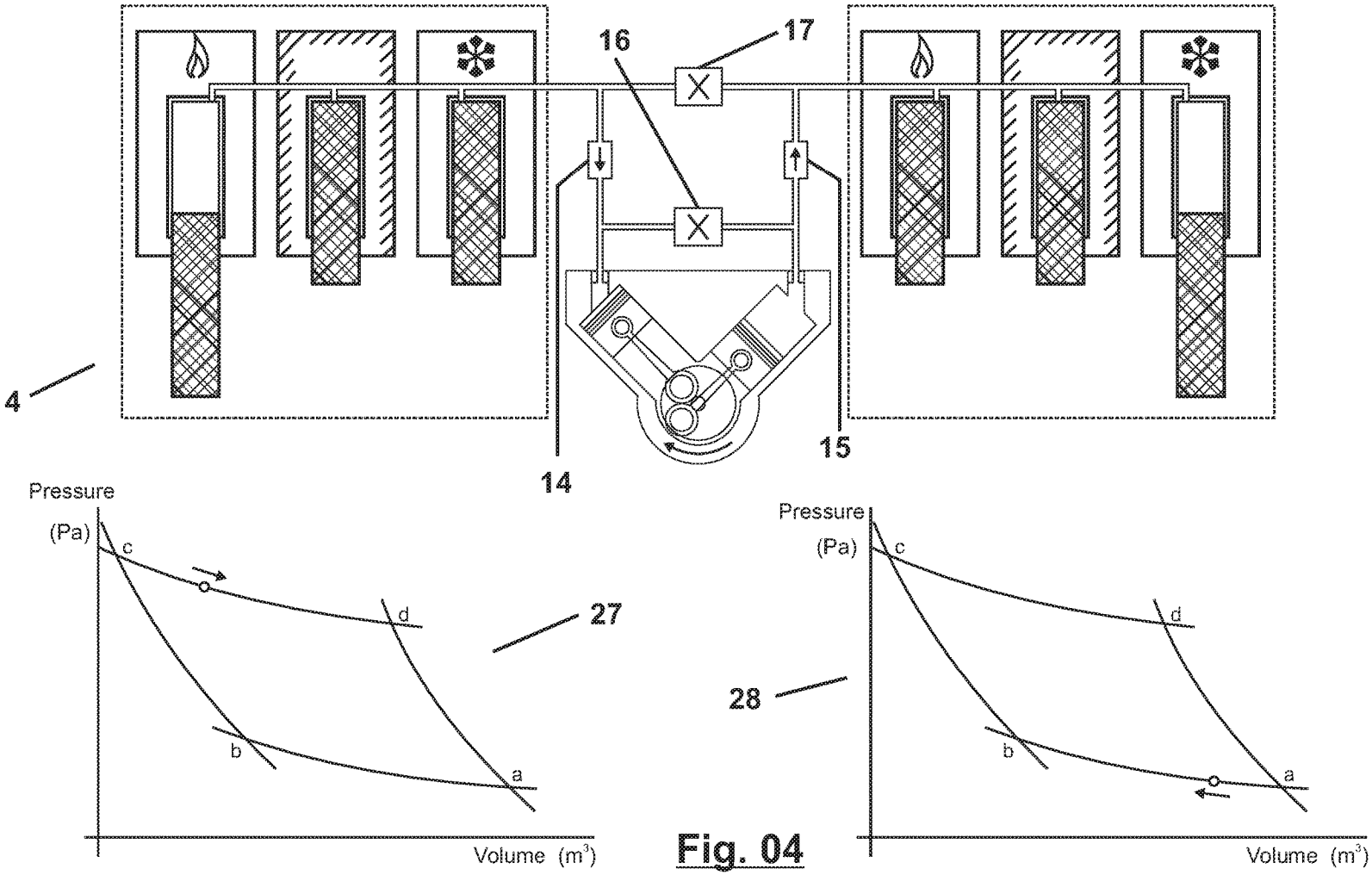
FIG. 04 shows the simplified mechanical model of the differential cycle engine 4 and its complete thermodynamic cycle formed bay two interdependent cycle or two half-cycle, the half-cycle 27 which runs in one of the subsystems, chamber 5, and the half-cycle 28 which runs in the second subsystem, chamber 6, wherein in the first subsystem 27 the heating and expansion isothermal process (cd) is taking place and in the second subsystem 28 the isothermal process of cooling and compression (ab) is taking place, starting the thermodynamic cycle of eight processes.

In FIG. 04 is shown the differential engine 4 with a chamber containing the working gas in the heated section performing a isothermal high temperature process shown in the graph 27 while the other chamber containing the working gas also in the refrigerated or cooled section performing a low temperature isothermal process shown in the graph 28. These changes occur a referenced to the other, and therefore is called "Differential". In this phase, the bypass valve 17 and valve 16 to release the inertial operation of the driving force element 7 are closed, the set control valve 14 and 15 are open allowing the realization of working gas on the driving force element or impellent 7.

Figure 5:
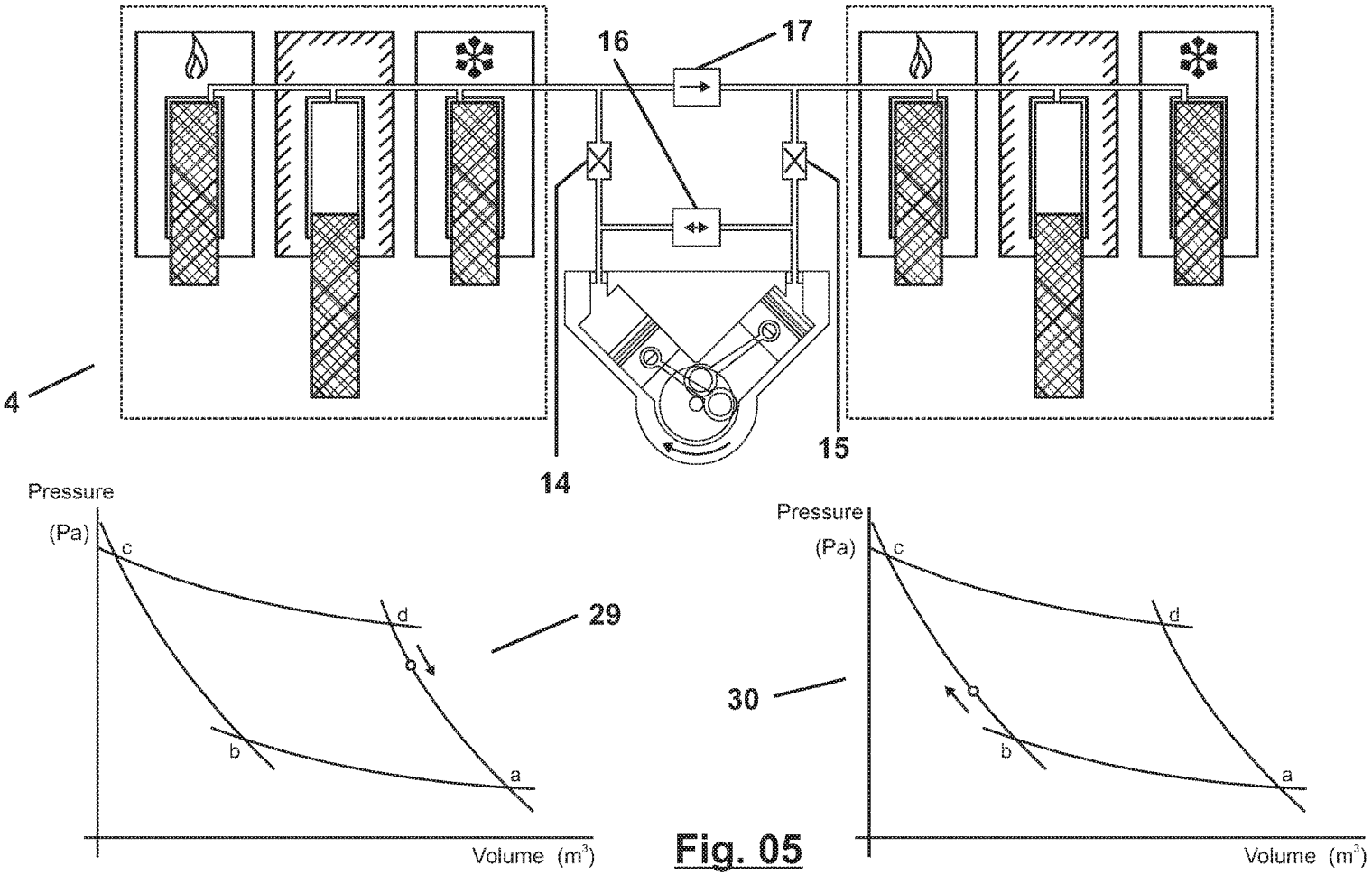
FIG. 05 shows the simplified mechanical model of the differential cycle engine 4 and its complete thermodynamic cycle, the half-cycle 29 rotating in one of the subsystems, chamber 5, and the half-cycle 30 rotating in the second subsystem, chamber 6, wherein in the first subsystem 29 the adiabatic expansion process with mass transfer (da) is occurring and in the second subsystem 30 the adiabatic compression process and mass reception (bc) is taking place.

In FIG. 05 is shown the differential engine 4 with a chamber containing the working gas in the isolated section performing its adiabatic process expansion 29 with mass transfer to the second chamber, while the other chamber also containing working gas in isolated section performing processing also adiabatic, but compression 30, receiving working gas of the first chamber. In this phase, the bypass valve 17 performs the transfer of gas particles from the first chamber, high temperature, into the second chamber, the low temperature valve 16 open allowing the continuity of crankshaft rotation 24 of the driving force element or impellent 7, control valves 14 and 15 are closed to meet the adiabatic processes.

Figure 6:
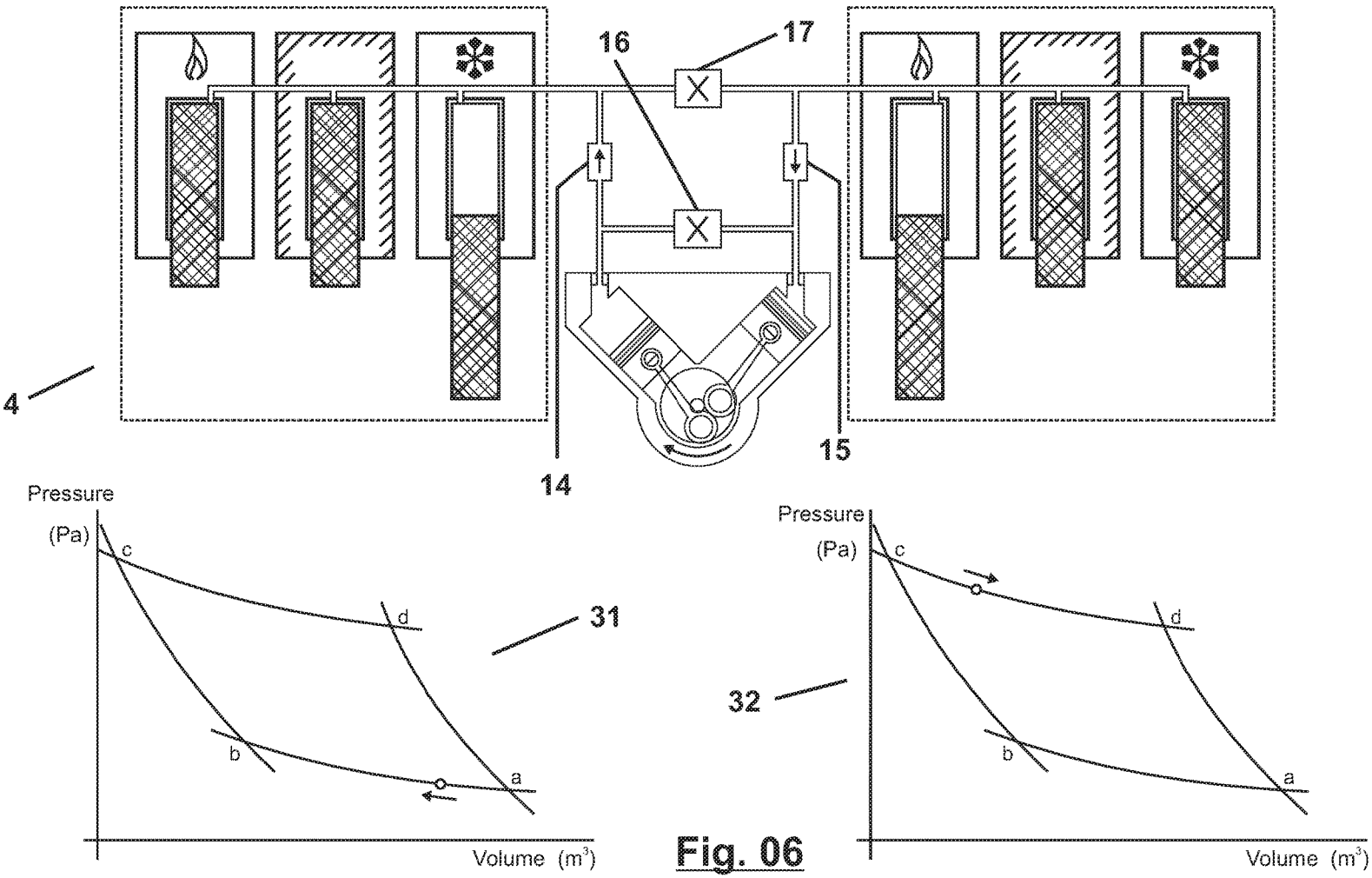
FIG. 06 shows the simplified mechanical model of the differential cycle engine 4 and its complete thermodynamic cycle, the half-cycle 31 which runs in one of the subsystems, chamber 5, and the half-cycle 32 rotating in the second subsystem, chamber 6, wherein in the first subsystem 31 the cooling and compression isothermal process (ab) is taking place and in the second subsystem 32 the heating and expansion isothermal process (cd) is taking place.

In FIG. 06 is shown the differential engine 4 now with the first chamber containing the working gas in the cold section performing a isothermal process of low temperature shown in the graph 31 while the other chamber in turn also containing gas work in section performing a heated isothermal process high temperature shown in the graph 32. In this phase, the bypass valve 17 and valve 16 to release the inertial operation of the element of driving force are closed, the control valve 14 and 15 are open allowing the realization of working gas on the driving force element or impellent 7.

Figure 7:
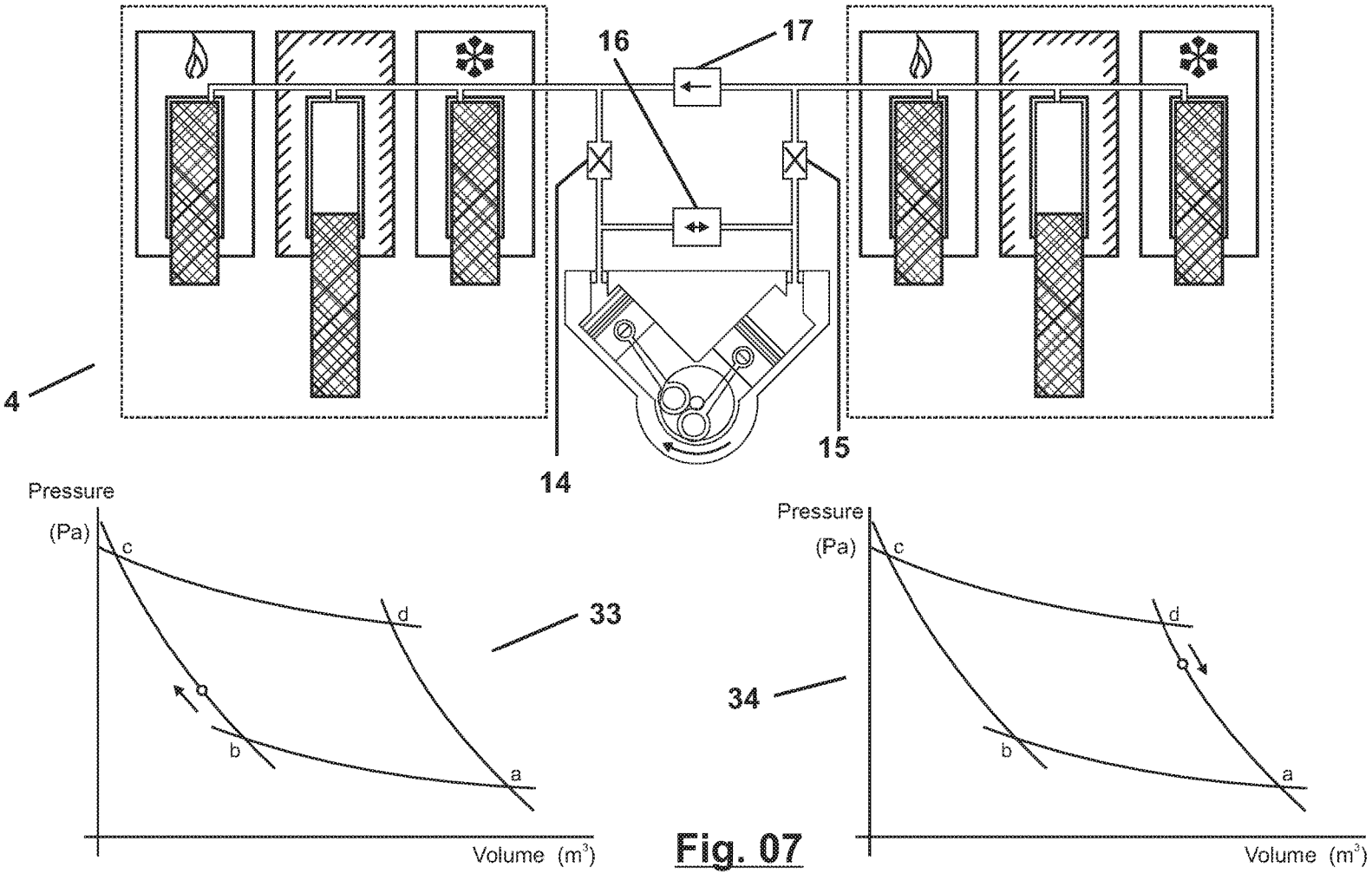
FIG. 07 shows the simplified mechanical model of the differential cycle engine 4 and its complete thermodynamic cycle, the half-cycle 33 rotating in one of the subsystems, chamber 5, and the half-cycle 34 rotating in the second subsystem, chamber 6, wherein in the first subsystem 33 the adiabatic compression process with mass reception (bc) is occurring and in the second subsystem 34 the adiabatic process of expansion and mass transfer (da) is taking place, finishing the thermodynamic cycle of eight processes.

In FIG. 07 is shown the differential engine 4 with a chamber containing the working gas in the isolated section performing its adiabatic process expansion 33 with mass transfer to the second chamber, while the other chamber also containing working gas in isolated section performing processing also adiabatic, but compression 34, receiving working gas of the first chamber. In this phase, the bypass valve 17 performs the transfer of gas particles from the first chamber, high temperature, into the second chamber, the low temperature valve 16 open allowing the continuity of crankshaft rotation 24 of the driving force element or impellent 7, control valves 14 and 15 are closed to meet the adiabatic processes.

Observing the process described above, it is obvious to understand that the differential configuration with mass transfer, the isothermal process high temperature gas shall always have more particles than the low-temperature isothermal process.

Figure 8:
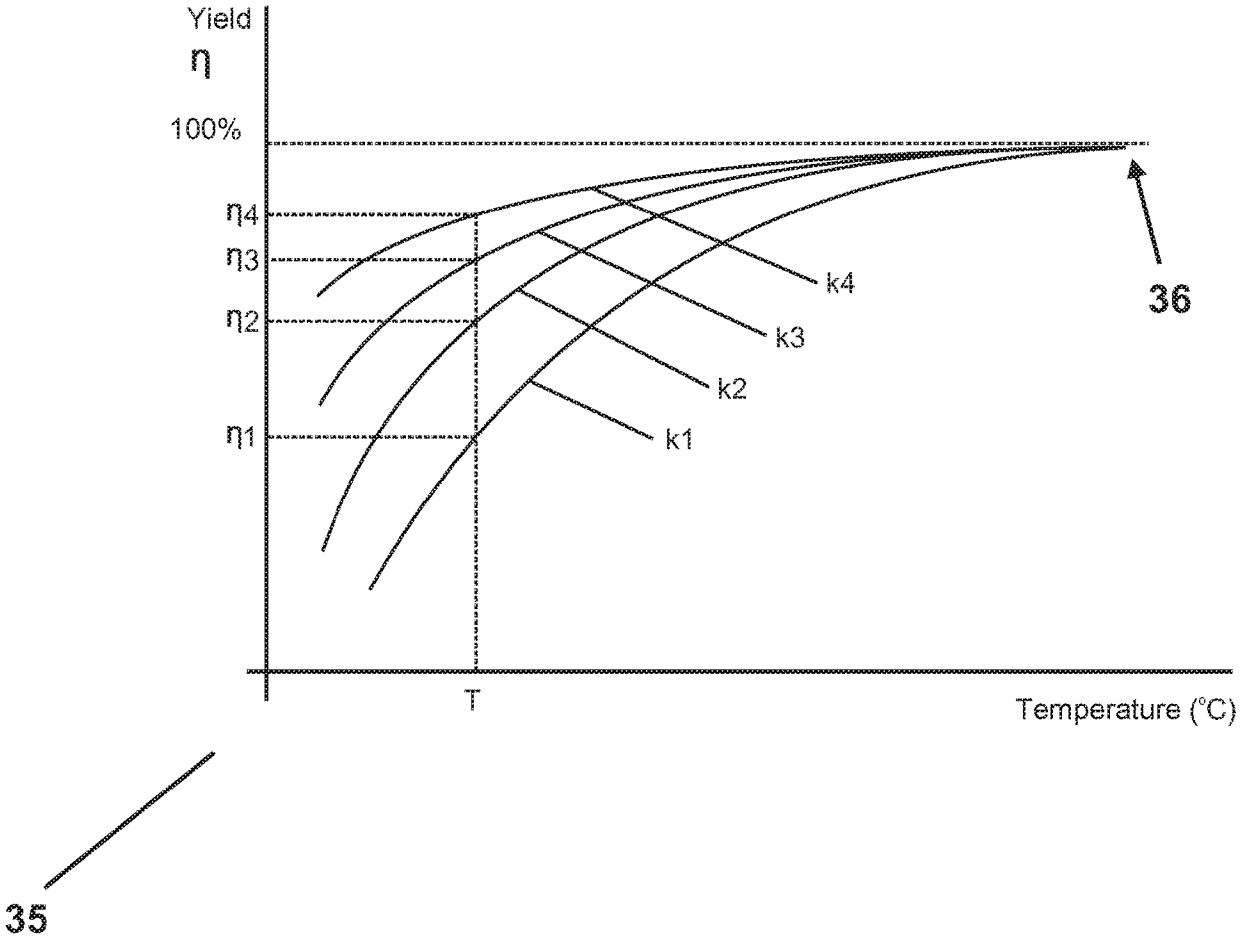
FIG. 08 shows the effect of mass transfer on the theoretical efficiency of the differential cycle.

In FIG. 08 is shown the efficiency graph of the "Thermal Differential Engine with Eight Thermodynamic Changes with Transfer of gas mass between chambers for different transfer rates of gas mass, to be explained in this text of patent of invention.

The fundamentals of this technology shall initially be demonstrated from the presentation of the original yield equation (a) of Carnot.

$$\eta = 1 - \frac{T_2}{T_1} \tag{a}$$

This equation is well known in the scientific community, it is accepted and used as reference level for obtaining the efficiency of a heat engine. It is based on the original design conceived by Carnot and shown in FIG. 01 in 1, the FIG. 01 in 2 the heat flow diagram of the Carnot engine is indicated, making it clear that there is a hot spring where there is the heat and the flow goes E1, part generates the work W and the remainder goes to the cold source E2. The thermodynamic cycle is reference of four processes shown in 3 still in FIG. 01, comprises two isotherms and two adiabatic changes.

In the above equation, $T_2$ is the temperature of the cold source and the temperature $T_1$ of the hot source, and the efficiency of this engine is likely to 100% at the boundary $T_2$ which tends to "zero".

There is no doubt that the Carnot fundamentals are correct, as there is no doubt about the income limits governed by the idealized formula above. However, the known engines are designed to perform their mechanical and thermodynamic cycle reference mode, or perform work and thermodynamic reference changes to its surroundings, the atmosphere when applied in our environment, the vacuum in the space or referenced to a chamber under certain fixed condition. The work of Nicolas Leonard Sadi Carnot considers these references as they are and the yield equation regarding these references.

Leaving the line of reasoning, references of existing models, keeping the same foundations of Carnot, the new heat engines may be designed in a differential configuration. Thus, the thermodynamic cycles do not occur with reference to the means, but with reference to another thermodynamic cycle simultaneously and out of phase manner and all calculations shall be a reference to another, creating new possibilities.

In FIG. 02 is presented the "Thermal Differential Engine with Eight Changes with Transfer of mass between chambers".

In FIG. 02, 5 indicates a chamber of thermodynamic processes composed of three sections, one heated section 8, one isolated section 9 and one cooled section 10, the gas will always occupy only one of the sections in each of the thermodynamic processes. In this chamber is processed four of the eight thermodynamic processes occurring in the same cycle, the gas during each phase of processing sections is transported through the pistons shown in the same figure. In the same FIG. 02, in 6 is shown another chamber, identical to the first, which handles the other four thermodynamic processes completing the thermodynamic cycle of eight processes, both are connected to each other in a differential configuration through the ducts 20 and 21, being between them, there are a driving force element or impellent 7, a bypass valve 17, a set of control valves 14 and 15, a valve to release the inertial operation of the element of the driving force 16. The driving force element comprises pistons 22 and 23 and shaft crankshaft type 24 depending on the characteristics of the system, the driving force element can be different and even be parts of known market, such as turbines, diaphragms, rotors operating on gas flow. In the same figure, the elements 8 and 11 show respectively the heated sections of the chambers 5 and 6, elements 9 and 12 show respectively the isolated sections of the chambers 5 and 6, elements 10 and 13 show respectively a cooled sections of the chamber 5 and 6.

In the technology presented in this text, the statement of Carnot does not change, "To have continued conversion of heat into work, a system must perform cycles between hot and cold sources, continuously. In each cycle, is withdrawn a certain amount of heat from the hot source (useful energy) which is partially converted into work, the remainder being rejected to the cold source (energy dissipated)".

Thus, the efficiency of an engine configuration with the differential transfer of gas particles, with a thermodynamic cycle of [[8]] eight processes shall be as equation (b).

$$\eta = 1 - \frac{1}{k} \cdot \frac{T_2}{T_1} \tag{b}$$

Where $T_2$ is the temperature of the cold source, $T_1$ the temperature of the hot source and k the particle transfer rate between the chambers, and the efficiency of this engine tends to 100% in two possible conditions at the boundary where $T_2$ tends to "zero" and the threshold where 1/k tends to zero, as can be seen in the graph 35, specifically at the point 36 shown in FIG. 08.

The yield of a heat engine is an extremely important factor, along with the operating temperature, both are key factors for power generation, use of alternative sources of low or no environmental impact. Such evidence can be seen in FIG. 08, the curve where k=k1=1 represents the curve of the ideal engine of Carnot, k=1, as the Carnot engine gas always remains in the same compartment, the number of particles never changes on the other hand, in a differential configuration allows to control this condition, making k4>k3>k2>k1=1 and thus, it is possible to obtain a heat engine of high efficiency with low thermal differential becoming viable projects power plant and power generation based on clean energy sources, renewable like the sun and geothermal, with less environmental impact using organic fuel, and also less harmful to the very use of fossil and nuclear sources simply by producing more power with less fuel consumption.

Figure 3:
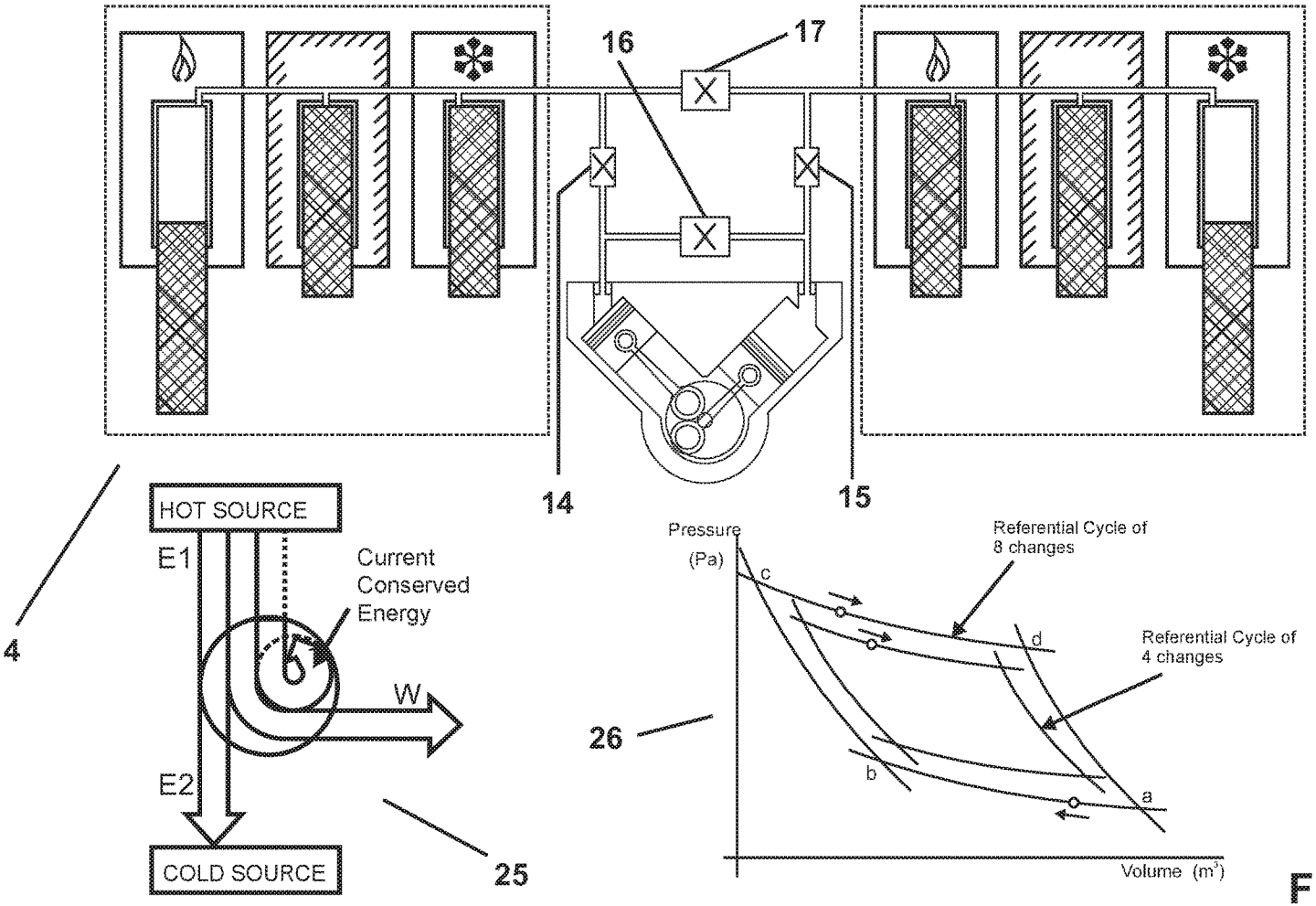
FIG. 03 represents the simplified mechanical model of differential cycle 4, the heat flow diagram 25 and a graph (P×V) comparing the curves of a cycle formed by four processes based on the open or closed thermodynamic system with the curves of an engine half-cycle based on the hybrid thermodynamic system.

Physically, the differential cycle of mass transfer consists in the passage of a certain amount of gas particles in the chamber that has completed its isothermal process of high to the chamber that has completed its isothermal process of low, however this transfer occurs during adiabatic processes causing an extension in curves as shown in the graph 26 of FIG. 03. While one chamber undergoes the effect of pressure drop, reducing the density (increase in volume) observed in (a) of the graph 26, on the other there is increased pressure, increased density, (volume reduction) observed in (c) of the graph 26. This extension of the curve increases the area of the cycle, i.e. the work done.

It is important to note that this is not a Stirling engine, it is not a Carnot engine, both are references, which is presenting is a differential engine. Thermodynamic fundamentals are absolutely the same.

The thermal differential engines perform simultaneous thermodynamic processes, shown by the arrows in high isothermal (c-d) and low (a-b) the graph 26 of FIG. 03, as they are differential, there are two chambers simultaneously performing their own thermodynamic cycle, but one referring to the other. This property allows the transfer of material between them in order to reduce the power supplied to the cold source. Otherwise, it is characterized by a differential thermodynamic cycle, ie, a cycle formed by two interdependent cycles that rotate simultaneously exchanging energy and mass of gas with each other and together generate mechanical force in a shaft or crankshaft.

The fundamentals of differential thermal engines are the same as other thermal engine, and the Carnot engine as a general reference.

Differential engine with cycle of eight thermodynamic processes performed simultaneously two by two, has a yield which can be mathematically demonstrated as follows:

From the original design of the Carnot engine designed by Nicolas Leonard Sadi Carnot, around 1820, but in a "differential" configuration, as being two engines connected to each other, out of phase by 180°, with mass transfer during adiabatic processes the referential of an engine would be not the environment but the other engine, both the mechanical system which performs work, such as the thermodynamic system.

The system formed by these two heat transfer chambers (energy) each perform their own thermodynamic cycle with the particles contained in them. It would be, therefore, an integrated system with two simultaneous thermodynamic cycles, delayed by 180° or a thermodynamic cycle with [[8]] eight processes occurring in pairs, delayed and interdependent because they exchange mass between itself and the expansions are performed on one another alternately and not against the environment.

The mass transfer occurs during the adiabatic processes after the chambers do work against each other in the high-isothermal, the control system would enable the passage of particles through the gas mass transfer element 17 of the upper chamber to the lower chamber, to achieve balance of pressures or in forced manner. Thus, fewer gas particles shall be available at low isothermal, reducing the loss of energy to the cold source. This stored energy shall circulate between the two chambers of the engine, shown in the flow diagram 25 of FIG. 03, providing increased efficiency and this fraction of energy cannot be used to generate work.

Thus, the output curve of an engine in a differential configuration with an eight processing cycle consisting of isothermal and adiabatic with mass transfer is more efficient than an engine reference configuration Carnot, although the limit with the temperature 12 tending to "zero", both have the same yield shown in FIG. 08.

According to the same grounds of Carnot, power input c-d, equation (c).

$$E1=W_{cd}=\int P\cdot dv \quad (c)$$

The general equation of gases.

$$P=\frac{n_1\cdot R\cdot T_1}{V} \quad (d)$$

$$W_{cd}=\int_{Vc}^{Vd}\frac{n_1\cdot R\cdot T_1}{V}\,dv \quad (e)$$

$$W_{cd}=n_1\cdot R\cdot T_1\cdot \ln(v)]_{vc}^{vd} \quad (f)$$

$$W_{cd}=n_1\cdot R\cdot T_1\cdot \ln\left(\frac{vd}{vc}\right) \quad (g)$$

And the energy in a—bis represented by equation (h).

$$E2=W_{ab}=\int P\cdot dv \quad (h)$$

The general equation of gases.

$$P=\frac{n_2\cdot R\cdot T_2}{V} \quad (i)$$

$$W_{ab}=\int_{Va}^{Vb}\frac{n_2\cdot R\cdot T_2}{V}\,dv \quad (j)$$

$$W_{ab}=n_2\cdot R\cdot T_2\cdot \ln(v)]_{va}^{vb} \quad (k)$$

$$W_{ab}=n_2\cdot R\cdot T_2\cdot \ln\left(\frac{vb}{va}\right) \quad (l)$$

The total quantity of energy associated to the work is:

$$W=W_{cd}+W_{da}+W_{ab}+W_{bc} \quad (m)$$

The processes d-a and b-c are adiabatic and internal energy depends only on the temperature, the initial and final temperatures of this process are equal and opposite, the number of exchanged particles is also identical, thus:

$$W_{da}=W_{bc} \quad (n)$$

And:

$$W=W_{cd}+W_{ab} \quad (o)$$

And the efficiency of the engine in accordance with the principles of thermodynamics in a differential configuration is represented by equation (p).

$$\eta=\frac{W_{cd}+W_{ab}}{W_{cd}} \quad (p)$$

Replacing by work equations:

$$\eta=\frac{n_1\cdot R\cdot T_1\cdot \ln\left(\frac{vd}{vc}\right)+n_2\cdot R\cdot T_2\cdot \ln\left(\frac{vb}{va}\right)}{n_1\cdot R\cdot T_1\cdot \ln\left(\frac{vd}{vc}\right)} \quad (q)$$

$$\frac{v_d}{v_c}=\frac{v_a}{v_b} \quad (r)$$

Considering that it is a closed system, reversible, the rate, and by properties of logarithms:

$$\eta=\frac{n_1\cdot R\cdot T_1\cdot \ln\left(\frac{vd}{vc}\right)-n_2\cdot R\cdot T_2\cdot \ln\left(\frac{vd}{vc}\right)}{n_1\cdot R\cdot T_1\cdot \ln\left(\frac{vd}{vc}\right)} \quad (s)$$

Simplifying:

$$\eta=\frac{n_1\cdot T_1-n_2\cdot T_2}{n_1\cdot T_1} \quad (t)$$

Then:

$$\eta=1-\frac{n_2\cdot T_2}{n_1\cdot T_1} \quad (u)$$

Observing now in a differential configuration with particles of gas transfer, not corrupting any of the thermodynamic grounds, the transfer of particles between the chambers in the adiabatic:

$$n_2<n_1 \quad (v)$$

Making:

$$k=\frac{n_1}{n_2} \quad (x)$$

Therefore, the efficiency of an engine configuration with the differential transfer of gas particles, with a cycle of eight processes or in other words, two simultaneous and interdependent thermodynamic cycles in accordance with Carnot cycle is:

$$\eta=1-\frac{1}{k}\cdot\frac{T_2}{T_1} \quad (y)$$

Where $T_2$ is the temperature of the cold source and $T_1$ the temperature of the hot source.

And the efficiency of this tends to 100% in two possible conditions at the boundary where $T_2$ tends to "zero" and the range where 1/k tends to zero, and then the chart 35 of FIG. 08, and this difference engine eight thermodynamic processes cycle equals the Carnot engine, which is an engine with four thermodynamic cycle changes in the condition of no mass transfer of gas, that is, only when k=1.

Examples of Applications

As described above, this invention provides substantial innovation for future energy systems, it has the property to operate with any heat source. Aims its application in power generation plants with the basic source, solar thermal and as complements, thermal sources of geological origin, biofuels and also in special cases or to supplement the fossil fuels and even nuclear. Exemplifying the fields of applications of this technology, as follows:

Large generating plants of electricity using thermosolar sources with concentrators and mirrored collectors, these plants can be designed to power between 10 MW and 1 GW.

Large generating plants having as heat sources the use of heat from the soil depths, obtained by passing a heat transfer fluid to the recycle stream obtaining heat from the depths, transporting it to the surface and, thus, being used in the chambers conversion.

Large generating plants having as a heat source in the combustion biofuel, biomass, waste and other organic waste products.

Large generating plants as a heat source with the use of traditional fossil fuels.

Small and medium-sized generating plants for distributed generation, with the heat source, small solar concentrators or small boilers burning of organic residues or waste residues.

Systems of power generation for spacecrafts, probes and space satellites with solar concentrators as a source of heat or nuclear sources, especially for exploration in deep space. For this application, includes the generation of high-power energy to meet the needs of ion propulsion engines in space.

Systems of power generation submarines AIP like, "Air Independent Propulsion", with the heat source, fuel cells.

Plants of power generation in space objects that have some source of heat, planets, natural satellites and other bodies such as the moon, for example, where heat can come from solar concentrators or thermonuclear sources.

Engines to generate mechanical force of vehicle traction.

We conclude that this is a technology that meets an unusual flexibility and can operate with any heat source, this means that allows projects combustion or simple heat flow, a differential configuration with mass transfer deletes the temperature dependence with efficiency, allowing high-efficiency engines, higher than the current, its independence oxygen gives applications for spacecraft and submarines, thus bring benefits in accordance with the standards that are sought in the present and the future.

The invention claimed is:

1. A heat engine comprising:

a pair of chambers configured for thermodynamic transformations, wherein each chamber is comprised of three sections, one heated section, one isolated section, and one cooled section, the two chambers connected in differential configuration through a pair of channels for a working gas flow;

a driving force element;

a bypass valve;

a valve to release an inertial operation of the driving force element; and a control valve assembly.

2. The heat engine of claim 1 wherein two interdependent thermodynamic subsystems occur within the pair of chambers.

3. The heat engine of claim 1 wherein the bypass valve is positioned between the pair of chambers and operates during an adiabatic process.

4. The heat engine of claim 1 wherein the driving force element operates in response to working gas forces generated in the pair of chambers during a thermodynamic process performing work.

5. The heat engine of claim 1 wherein the control valve assembly provides the passage of working gas between the pair of chambers to the driving force element.

6. A method of controlling the operation of differential thermal machines utilizing the heat engine of claim 1, comprising the steps of:

generating a differential thermodynamic cycle, wherein the differential thermodynamic cycle is formed by two interdependent cycles, that rotate simultaneously exchanging energy and mass of gas with each other and together generate a mechanical force in a crankshaft, and the differential thermodynamic cycle consists of eight processes, one cycle of four processes in a first subsystem contained within a first chamber of the pair of chambers, and another cycle of four processes in a second subsystem contained within a second chamber of the pair of chambers, wherein the eight processes comprise the steps of:

performing a heating and expansion isothermal process (cd) in the first subsystem;

performing a cooling and compression (ab) isothermal process in the second subsystem thereby starting the thermodynamic cycle of eight processes;

performing an adiabatic expansion process with mass transfer (da) in the first subsystem;

performing an adiabatic compression process and mass reception (bc) in the second subsystem;

performing a cooling and compression isothermal process (ab) in the first subsystem;

performing a heating and expansion isothermal process (cd) in the second subsystem;

performing an adiabatic compression process with mass reception (bc) in the first subsystem; and performing an adiabatic expansion process with mass transfer (da) in the second subsystem, thus finishing the thermodynamic cycle of eight processes.

* * * * *